United States Patent [19]

Ogawa et al.

[11] Patent Number: 4,565,777

[45] Date of Patent: Jan. 21, 1986

[54] SILVER HALIDE COLOR PHOTOGRAPHIC LIGHT-SENSITIVE MATERIALS

[75] Inventors: Akira Ogawa; Kozo Aoki; Osami Tanabe; Makoto Umemoto, all of Kanagawa, Japan

[73] Assignee: Fuji Photo Film Co., Ltd., Kanagawa, Japan

[21] Appl. No.: 632,735

[22] Filed: Jul. 20, 1984

[30] Foreign Application Priority Data

Jul. 21, 1983 [JP] Japan ..... 58-133293

[51] Int. Cl.[4] ..... G03C 7/32

[52] U.S. Cl. ..... 430/552; 430/553; 430/554; 430/555; 430/556; 430/557; 430/558; 430/565

[58] Field of Search ..... 430/552, 553, 554, 555, 430/556, 557, 558, 565

[56] References Cited

U.S. PATENT DOCUMENTS

| | | | |
|---|---|---|---|
| 2,908,573 | 10/1959 | Bush et al. | 430/552 |
| 3,652,286 | 3/1972 | Credner et al. | 430/553 |
| 3,998,642 | 12/1976 | Lau et al. | 430/553 |
| 4,273,861 | 6/1981 | Shiba et al. | 430/555 |
| 4,341,864 | 7/1982 | Vandewalle et al. | 430/552 |
| 4,463,086 | 7/1984 | Sasaki et al. | 430/554 |

*Primary Examiner*—J. Travis Brown

*Attorney, Agent, or Firm*—Sughrue, Mion, Zinn, Macpeak, and Seas

[57] ABSTRACT

A silver halide color photographic light-sensitive material is described, comprising a coupler represented by formula (I):

(I)

wherein A represents the residue of a coupler, $R_1$ represents an alkyl group having from 4 to 15 carbon atoms, $R_2$ represents an alkyl group having from 1 to 20 carbon atoms, with the total number of carbon atoms of $R_1$ and $R_2$ being from 8 to 27.

9 Claims, No Drawings

SILVER HALIDE COLOR PHOTOGRAPHIC LIGHT-SENSITIVE MATERIALS

FIELD OF THE INVENTION

The present invention relates to color photographic light-sensitive materials containing novel couplers.

BACKGROUND OF THE INVENTION

In order to form color photographic images by a subtractive process, a process of forming cyan, magenta and yellow dye images which comprises reducing silver halide grains in exposed or chemically fogged emulsions with a developing agent such as an aromatic primary amine compound, particularly, an N,N-disubstituted p-phenylenediamine compound, to cause reactions of couplers with a simultaneously formed oxidation product of the developing agent is generally utilized.

Couplers used for the above-described color developing process are compounds having a phenolic hydroxyl group, an anilinic amino group, an active methylene group or an active methine group which form a dye by oxidative coupling with an aromatic primary amine developing agent.

Suitable couplers which form a cyan dye by reacting with an oxidation product of the color developing agent are phenols and naphthols. Exemplary couplers forming a magenta dye are pyrazolones, pyrazolotriazoles, pyrazolobenzimidazolones, imidazolones, cyanoacetophenones and diaminoaniline, etc. Couplers forming a yellow dye include $\alpha$-amylacetamides, $\beta$-ketoacetic acid esters and N,N-malondiamines, etc.

In order to add couplers as described above to photographic emulsion layers, various methods have been proposed. However, it is preferred to use a method of adding couplers which comprises dissolving couplers with a ballast group in the coupler in an organic solvent, and dispersing the solution by emulsification. Characteristics required for such couplers having a ballast group in order to produce color light-sensitive materials having excellent photographic properties are as follows. Namely, (1) Couplers and developed dyes formed by color development have high solubility in high boiling point organic solvents (for example, tricresyl phosphate) used for dispersing the couplers.

(2) Silver halide photographic emulsions having dispersed therein the couplers have high stability and when the emulsions are applied to a support and dried, stable coating films are obtained.

(3) They have an excellent antidiffusion property and do not diffuse into other layers.

(4) They have an excellent dyeing property, and dyed color images have an excellent spectral absorption characteristic. Further, they have good color and density stabilities and high fastness to light.

(5) They can be obtained in good purity and high yield from inexpensive raw materials by a simple synthetic process.

Hitherto, many attempts of modifying the structure of ballast group have been made in order to improve the above-described characteristics. Examples of these attempts have been described in Japanese Patent Publication Nos. 5582/67, 5391/71 and 27563/64, U.S. Pat. Nos. 2,589,004 and 2,908,573, Japanese Patent Publication No. 3660/69, U.S. Pat. Nos. 2,474,293, 2,039,970 and 2,920,961, Japanese Patent Publication No. 36078/71, U.S. Pat. No. 2,589,004, British Pat. No. 944,838, Japanese Patent Publication No. 19026/71, U.S. Pat. No. 2,659,329, British Pat. No. 1,813,832, Japanese Patent Application (OPI) No. 76834/78 (the term "OPI" as used herein refers to a "published unexamined Japanese patent application"), Japanese Patent Publication No. 36856/79, Japanese Patent Application (OPI) No. 82411/78, German Patent Application (OLS) No. 2,707,488, and Japanese Patent Application (OPI) Nos. 139534/78, 141622/78, 23528/79, 48541/79, 65035/79, 99433/79 and 121126/79, etc.

However, couplers having a ballast group known hitherto have some disadvantages and they do not satisfy the above-described characteristics which are required for them. Many of these couplers with an oleophilic ballast group have excellent stability and antidiffusibility in emulsion layers, spectral absorption characteristics of color images, durability of color images and aptitude for synthesis as compared with other types of coupler (for example, couplers having an acid group which are added to emulsion layers as a micellar aqueous solution). However, those which have a satisfactory color forming property have not been found yet. In rapid processing at high temperature which has been used actively in recent years, the color forming property is particularly important, and insufficient color formation becomes a serious problem. In order to compensate for this insufficient color formation, depending on the circumstances addition of an organic solvent such as benzyl alcohol as a color forming accelerator to the developing solution has been employed. However, organic solvents for accelerating color formation have some disadvantages. For example, (1) Since they are absorbed in the emulsion layers in the development step, the amount thereof in the developing solution is reduced with deterioration of color formation occurring.

(2) They are carried into the bleaching solution or the blixing solution with obstruction of desilvering or deterioration of dye densities occurring.

(3) They remain in the light-sensitive materials after processing deteriorating the fastness of color images.

(4) They are admixed with waste liquors causing an increase of B.O.D. and C.O.D. in the waste liquors. Therefore, it has been highly desired to remove or reduce the amount of organic solvents for accelerating color formation.

In couplers containing a ballast group having a p-hydroxyphenylenesulfonyl group or a p-hydroxyphenylenesulfinyl group at the terminal of the group as described in European Patent Publication (Unexamined) no. 73636, improvement of the color forming property is observed as compared with prior couplers, but even so the degree of improvement is not sufficient yet. Further, they have the disadvantage of having low solubility in organic solvents for dispersing couplers.

SUMMARY OF THE INVENTION

A first object of the present invention is to provide couplers suitable for color photographic light-sensitive materials having excellent photographic properties.

A second object of the present invention is to provide color photographic light-sensitive materials having silver halide emulsions which contain couplers with a novel substituent which are readily soluble in a high-boiling organic solvent used to disperse couplers.

A third object of the present invention is to provide color photographic light-sensitive materials using couplers having a novel substituent by which a sufficient color forming property is obtained even if organic solvents for accelerating color formation such as benzyl alcohol, etc., are not present in the color developing solution or the amount present in the color developing solution is reduced.

A fourth object of the present invention is to provide color photographic light-sensitive materials suitable for rapid processing at high temperature, wherein novel couplers are used.

It has now been found that the above objects can be achieved with a silver halide photographic light-sensitive material comprising a coupler represented by formula (I):

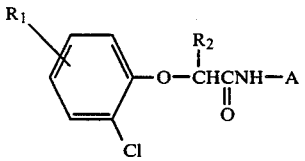

(I)

wherein A represents the residue of a coupler, $R_1$ represents an alkyl group having from 4 to 15 carbon atoms, $R_2$ represents an alkyl group having from 1 to 20 carbon atoms, with the total number of carbon atoms of $R_1$ and $R_2$ being from 8 to 27, and $R_1$ is preferably positioned at the para-position of the phenyl nucleus against —O— (or the meta-position against Cl). Further, the

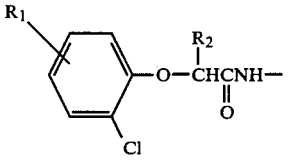

moiety preferably bonds to A at a position other than the coupling position of A.

The alkyl groups may be linear, branched, or cyclic, but $R_1$ is preferably a branched alkyl group.

DETAILED DESCRIPTION OF THE INVENTION

A in the formula (I) represents the residue of a yellow coupler, a magenta coupler, or a cyan coupler, or the residue of a coupler which forms a black or gray dye or substantially no dye.

Examples of yellow coupler residues include those derived from couplers of the pivaloyl acetanilide type, benzoyl acetanilide type, malonic diester type, malonic diamide type, dibenzoyl methane type, benzothiazolyl acetamide type, malonic ester monoamide type, benzothiazolyl acetate type, benzoxazolyl acetamide type, benzoxazolyl acetate type, benzimidazolyl acetamide type, and benzimidazolyl acetate type. They further include coupler residues derived from a heterocyclic ring-substituted acetamide or acetate, as disclosed in U.S. Pat. No. 3,841,880; coupler residues derived from acylacetamides, as disclosed in U.S. Pat. No. 3,770,446, British Pat. No. 1,459,171, West German Patent (OLS) No. 2,503,099, Japanese Patent Application (OPI) No. 139738/75, and *Research Disclosure,* No. 15737, May (1977); and heterocyclic type coupler residues as disclosed in U.S. Pat. No. 4,046,574.

Examples of magenta couplers from which residue A may be derived include those of the 5-oxo-2-pyrazoline type, pyrazolobenzimidazole type, pyrazolotriazole type, cyanoacetophenone type, and pyrazoloimidazole type. They further include couplers of the N-heterocyclic ring-substituted acylacetamide type as disclosed in West German Pat. (OLS) No. 3,121,955.

Examples of cyan couplers from which residue A may be derived include those having a phenol nucleus or α-naphthol nucleus.

A in the formula (I) also reresents the residue of a coupler which forms a black dye or gray dye on reaction with the oxidation product of a color developing agent. Examples of such couplers include resorcin and 3-aminophenol.

In addition, examples of couplers which form substantially no dyes include those of indanone type and acetophenone type as disclosed in U.S. Pat. Nos. 4,052,213, 4,088,491, 3,632,345, 3,958,993, 3,961,959, 4,046,574 and 3,938,996. A competitive reaction takes place between a coupler which forms no dyes and a coupler which forms a dye upon reaction with the oxidation product of the color developing agent. As a result of this competitive reaction, the gradation is adjusted and the graininess is improved.

A preferred coupler used in the present invention is represented by formula (II):

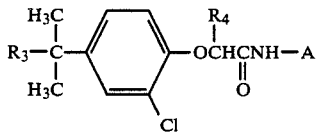

(II)

wherein $R_3$ represents an alkyl group having from 1 to 7 carbon atoms, $R_4$ represents an alkyl group having from 4 to 16 carbon atoms, with the total number of carbon atoms of $R_3$ and $R_4$ being from 8 to 22, and A is defined as in formula (I).

A more preferred coupler according to the present invention is represented by formula (III):

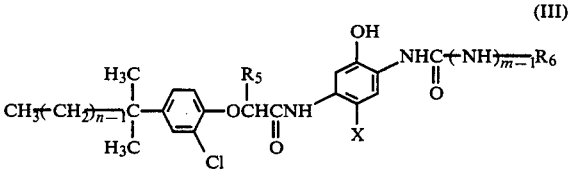

(III)

wherein $R_5$ represents an alkyl group having from 4 to 12 carbon atoms, $R_6$ represents an aryl group having from 6 to 20 carbon atoms, an alkyl group having from 1 to 20 carbon atoms, or a 5- or 6-membered heterocyclic group, n is an integer of 1 to 6, m is an integer of 1 or 2, and X represents a group which can be eliminted (also referred to as a coupling-off group) by an oxidation coupling reaction with a color developing agent.

A very preferred coupler according to this invention is represented by formula (IV):

(IV)

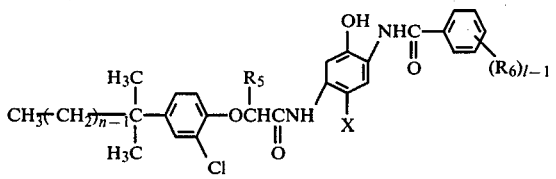

wherein $R_6$ represents a halogen atom, an alkyl group having from 1 to 4 carbon atoms, or an alkoxy group having from 1 to 4 carbon atoms, l is an integer of 1 to 6, and when l is an integer of 3 or more, the groups represented by $R_6$ may be the same or different, and $R_5$, n, and X are the same as for formula (III) above.

Shown below are examples of couplers represented by formula (I). The scope of this invention is not limited thereby.

(1)

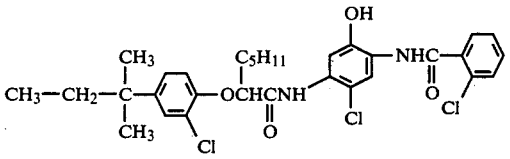

(2)

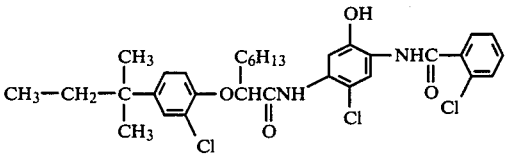

(3)

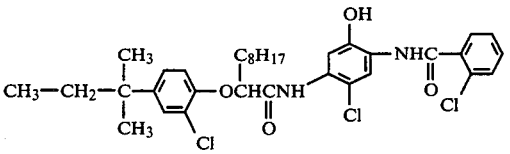

(4)

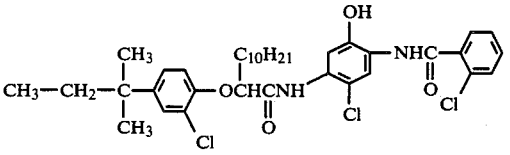

(5)

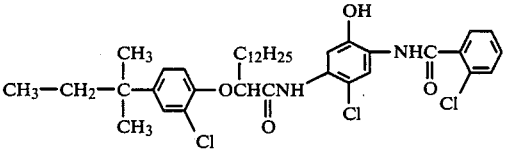

(6)

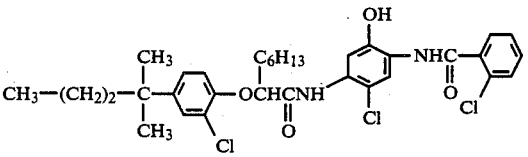

(7)

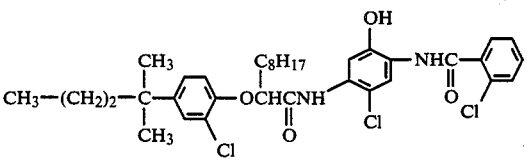

-continued (8)

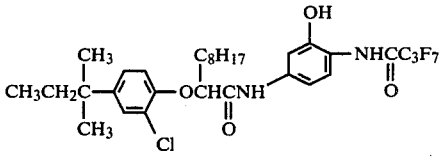

(9)

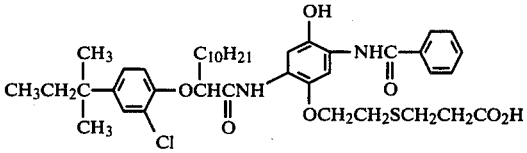

(10)

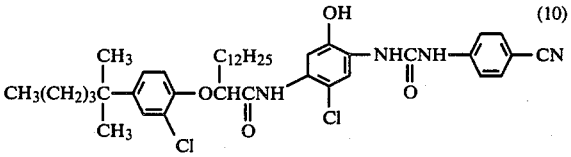

(11)

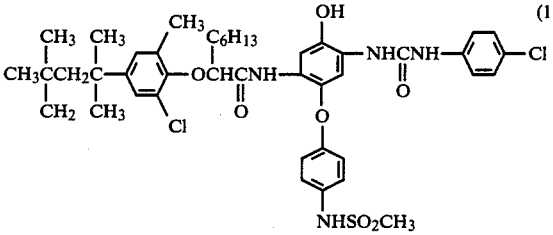

(12)

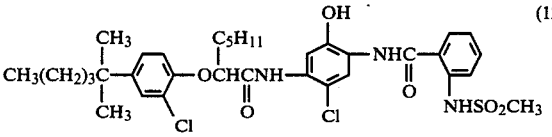

(13)

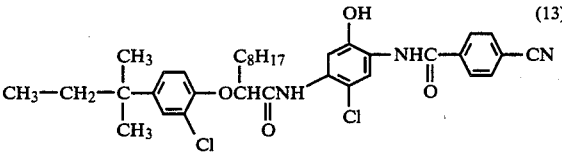

(14)

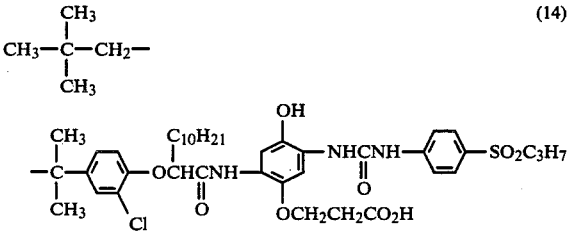

(15)

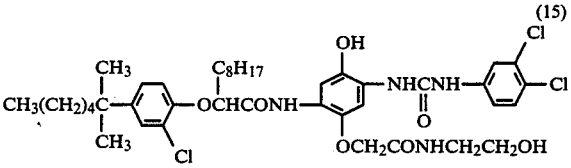

(16)

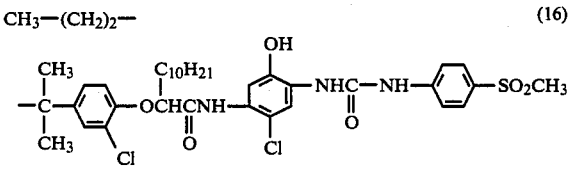

-continued
(17)
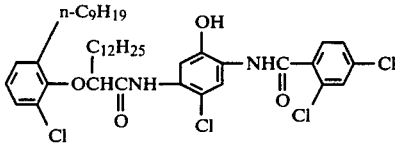
(18)
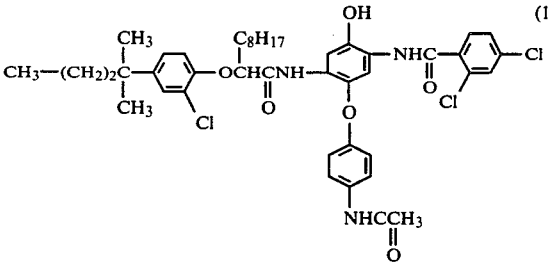
(19)
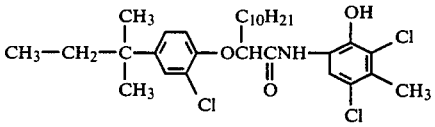
(20)
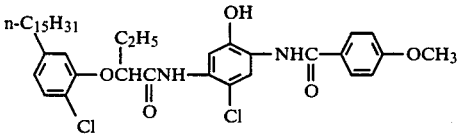
(21)
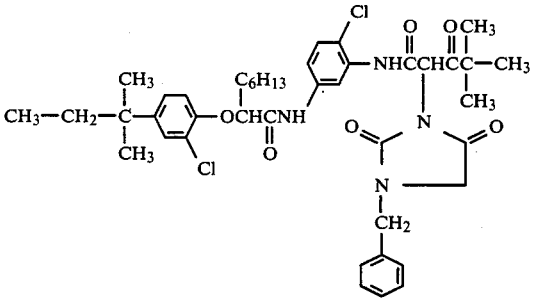
(22)
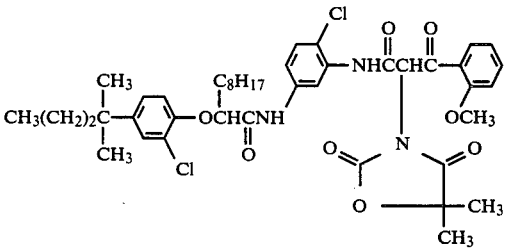
(23)
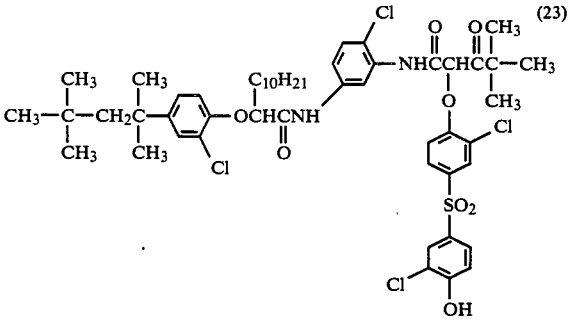
-continued
(24)
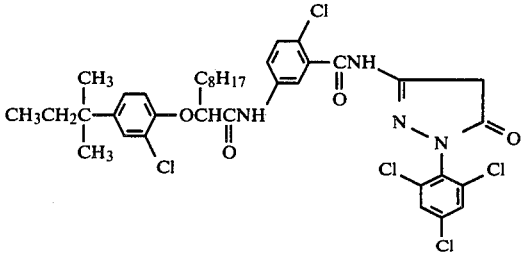
(25)
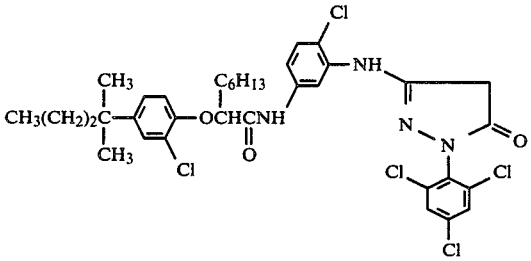
(26)
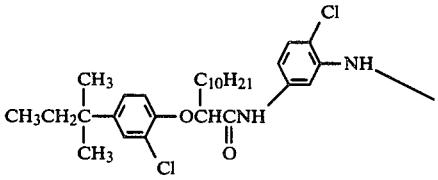
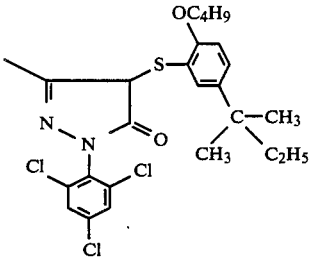
(27)
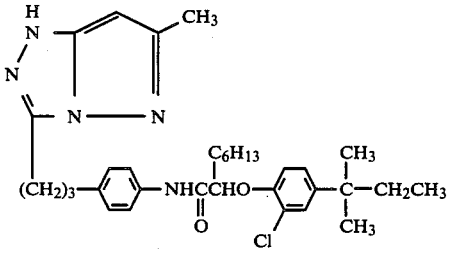
(28)
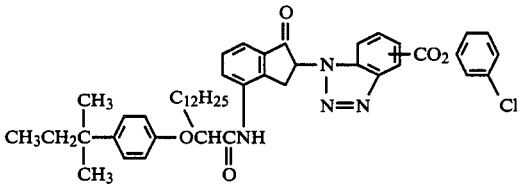
(29)
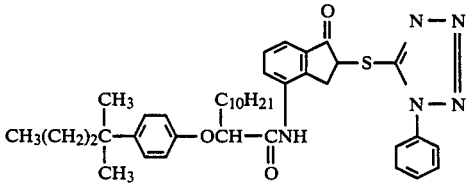

-continued

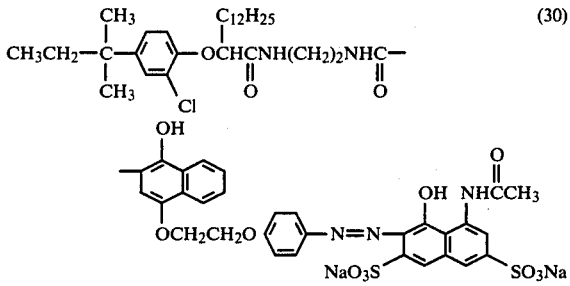

(30)

The coupler of the present invention can be easily synthesized through routes as shown below.

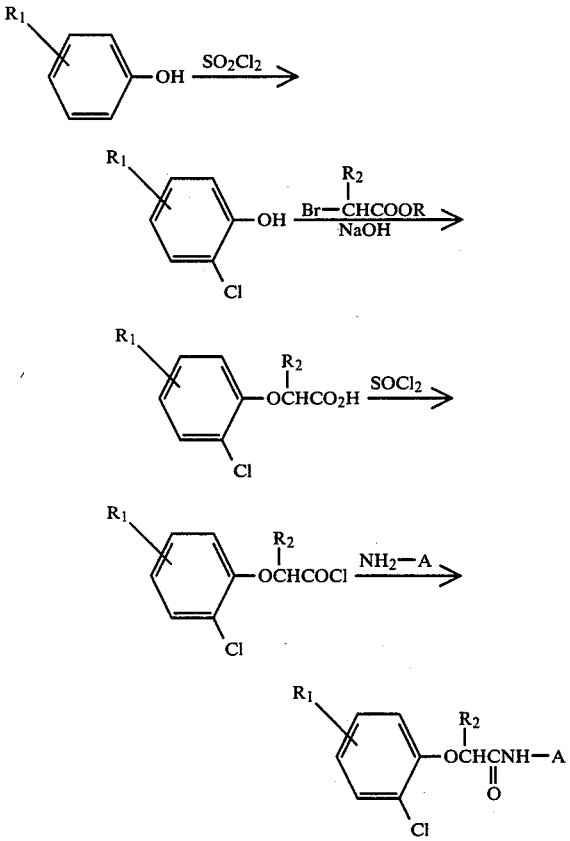

(I)

wherein R represents a hydrogen atom or an alkyl group, and $R_1$, $R_2$, and A are as defined above.

In the case wherein A is a 4-equivalent coupler, it can be converted into a 2-equivalent coupler by introducing a coupling-off group according to the known process. For example, a coupler of the acylacetamide type in which an aryloxy group is the coupling-off group can be synthesized by halogenating the coupling position of the 4-equivalent coupler and reacting the resulting product with a phenol compound in the presence of a base.

Couplers of the oxygen-ether coupling-off type, such as couplers of the 5-pyrazolone type, couplers of the phenolic type, couplers of the naphtholic type, and some couplers of the acylacetamide type, can be synthesized by reacting the hydroxy at the coupling position of a 4-equivalent coupler and an active halogenated compound in the presence of a base.

Couplers of the thioether coupling-off type can be synthesized by reacting a 4-equivalent coupler and sulfenyl chloride (which becomes the coupling-off group) in the presence or absence of a base.

The processes for synthesizing these 2-equivalent couplers are described in U.S. Pat. Nos. 3,894,875, 3,933,501, 4,296,199, 3,227,554, 3,476,563, 4,296,200, 4,234,678, 4,228,233, 4,351,897, 4,264,723, 4,366,237, and 3,408,194, and Japanese Patent Application (OPI) Nos. 70871/82, 96343/82 and 52423/78.

Below are typical examples of synthesis of couplers of the present invention.

SYNTHESIS EXAMPLE 1

Synthesis of Coupler (1)

(1) Synthesis of 2-(4-t-Amyl-2-chlorophenoxy)-enanthic Acid:

40.3 g of ethyl 2-bromoenanthate was added dropwise with stirring over 1 hour to a mixture (heated at 80° C.) composed of 37.2 g of 4-t-amyl-2-chlorophenol, 200 ml of toluene, and 20.4 g of sodium hydroxide. The reaction was carried out at 80° C. for 3 hours. After cooling with water, 300 ml of water was added, and then 40 ml of concentrated hydrochloric acid was added dropwise. The organic layer which separated out was washed twice with water and dried over magnesium sulfate, followed by concentration under reduced pressure. There was thus obtained 55 g of an oily substance.

(2) Synthesis of Coupler (1):

20.3 ml of thionyl chloride was added slowly dropwise with stirring to a mixture (heated at 60° C.) composed of 46 g of 2-(4-t-amyl-2-chlorophenoxy)enanthic acid and 46 ml of toluene. The reaction was carried out at 60° C. for 2 hours. Excess thionyl chloride and toluene were distilled off under reduced pressure. There was thus obtained 48 g of 2-(4-t-amyl-2-chlorophenoxy)enanthic acid chloride.

38.0 g of 2-(4-t-amyl-2-chlorophenoxy)enanthic acid chloride was added dropwise over 1 hour under reflux to 29.7 g of 5-amino-4-chloro-2-(2-chlorobenzoyl)-aminophenol suspended in 140 ml of acetonitrile and 70 ml of ethyl acetate. The reaction was carried out for 5 hours while heating under reflux. The reaction product was allowed to stand at 20° to 25° C. The crystals which separated out were filtered off. Yield: 57 g (94.1%). Melting Point: 90° to 93° C. The crude crystals were recrystallized from a mixed solvent of ethyl acetate (50 ml) and acetonitrile (100 ml). There was thus obtained 51 g of the exemplified Coupler (1). Melting Point: 95° to 97° C.

SYNTHESIS EXAMPLE 2

Synthesis of Coupler (3)

(1) Synthesis of 2-(4-t-Amyl-2-chlorophenoxy)capric Acid:

15 g of 4-t-amyl-2-chlorophenol was dissolved in 600 ml of toluene, and 128 g of sodium hydroxide was added to the solution. To the solution heated to 80° C. 223 g of ethyl 2-bromocaprate was added dropwise with stirring over 3 hours. The reaction was carried out at 80° C. for 2 hours. After cooling with water, 800 ml of water was added, and then 230 ml of concentrated hydrochloric acid was added dropwise. The organic layer which separated out was washed twice with water and dried over magnesium sulfate, followed by concentration under reduced pressure. There was thus obtained 295 g of an oily substance.

(2) Synthesis of Coupler (3):

90 ml of thionyl chloride was added dropwise with stirring to 230 g of 2-(4-t-amyl-2-chlorophenoxy)capric acid dissolved in 230 ml of toluene heated to 60° C. The reaction was carried out at 60° C. for 2 hours. Excess thionyl chloride and toluene were distilled of under reduced pressure. There was thus obtained 241 g of 2-(4-t-amyl-2-chlorophenoxy)capric acid chloride.

69.9 g of 2-(4-t-amyl-2-chlorophenoxy)capric acid chloride was added dropwise over 1 hour under reflux to 50.5 g of 5-amino-4-chloro-2-(2-chlorobenzoyl-)aminophenol suspended in 220 ml of acetonitrile and 110 ml of ethyl acetate. The reaction was carried out for 4 hours while heating under reflux. The reaction product was allowed to stand at 15° to 25° C. The crystals which separated out were filtered off. Upon recrystallization from a mixed solvent of ethyl acetate and n-hexane, there was obtained 69 g of the exemplified Coupler (3). Melting Point: 117° to 120° C.

SYNTHESIS EXAMPLE 3

Synthesis of Coupler (7)

(1) Synthesis of 2-(4-t-Hexyl-2-chlorophenoxy)capric Acid:

21.3 g of 4-t-hexyl-2-chlorophenol was dissolved in 100 ml of toluene, and 16 g of sodium hydroxide was added to the solution. To the solution heated to 80° C., 27.9 g of ethyl 2-bromocaprate was added dropwise with stirring over 1 hour. The reaction was carried out at 80° C. for 3 hours. After cooling with water, 200 ml of water was added and then 30 ml of concentrated hydrochloric acid was added dropwise. The organic layer which separated out was washed twice with water and dried over magnesium sulfate, followed by concentration under reduced pressure. There was thus obtained 38.3 g of 2-(4-t-hexyl-2-chlorophenoxy)capric acid.

(2) Synthesis of Coupler (7):

9.7 ml of thionyl chloride was added dropwise with stirring to 34.4 g of 2-(4-t-hexyl-2-chlorophenoxy)capric acid dissolved in 34 ml of toluene heated to 60° C. The reaction was carried out at 60° C. for 2 hours. Excess thionyl chloride and toluene were distilled off under reduced pressure. 40.1 g of 2-(4-t-hexyl-2-chlorophenoxy)capric acid chloride was obtained.

33 g of 2-(4-t-hexyl-2-chlorophenoxy)capric acid chloride was added dropwise over 1 hour under reflux to 22.3 g of 5-amino-4-chloro-2-(2-chlorobenzoyl-)aminophenol suspended in 150 ml of acetonitrile and 50 ml of ethyl acetate. The reaction was carried out for 4 hours while heating under reflux. The reaction product was allowed to stand at 20° to 25° C. The crystals which separated out were filtered off. Yield: 29.7 g. Melting Point: 110° to 112° C.

Upon recrystallization from a mixed solvent of ethyl acetate (50 ml) and acetonitrile (150 ml), 23 g of the exemplified Coupler (7) was obtained. Melting Point: 112° to 113° C.

The photographic emulsion prepared according to this invention may contain other color dye-forming couplers in addition to those of this invention. Couplers of nondiffusible type which have a hydrophobic group called a ballast group in the molecuule are preferred. They may have a value of equivalence which is either four or two for silver ions. In addition, the photographic emulsion may contain colored couplers which perform color correction and so-called DIR couplers which release a development inhibitor as the development proceeds. The coupler may be one which forms a colorless product upon coupling reaction.

Known ring-opened ketomethylene type couplers can be used as yellow couplers. Among others, benzoylacetanilide type compounds and pivaloylacetanilide type compounds can be advantageously used. Examples of yellow couplers capable of being used include those described in U.S. Pat. Nos. 2,875,057, 3,265,506, 3,408,194, 3,551,155, 3,582,322, 3,725,072 and 3,891,445, German Pat. No. 1,547,868, German Patent Application (OLS) Nos. 2,219,917, 2,261,361 and 2,414,006, British Pat. No. 1,425,020, Japanese Patent Publication No. 10783/76 and Japanese Patent Application (OPI) Nos. 26133/72, 73147/73, 102636/76, 6341/75, 123342/75, 130442/75, 21827/76, 87650/75, 82424/77 and 115219/77, etc.

Pyrazolone type compounds, imidazolone type compounds and cyanoacetyl type compounds, etc., can be used as magenta couplers. Particularly, pyrazolone type compounds can be advantageously used. Examples of magenta couplers capable of being used include those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, German Pat. No. 1,810,464, German Patent Application (OLS) Nos. 2,408,665, 2,417,945, 2,418,959 and 2,424,467, Japanese Patent Publication No. 6031/65 and Japanese Patent Application (OPI) Nos. 20826/76, 58922/77, 129538/74, 74027/74, 159336/75, 42121/77, 74028/74, 60233/75, 26541/76 and 55122/78, etc.

Phenol type compounds and naphthol type compounds, etc., can be used as cyan couplers. Examples of these couplers include those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, German Patent Application (OLS) Nos. 2,414,830 and 2,454,329 and Japanese Patent Application (OPI) Nos. 59838/73, 26034/76, 5055/73, 146828/76, 69624/77 and 90932/77.

It is possible to use, for example, those described in U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77, and German Patent Application (OLS) No. 2,418,959 as colored couplers.

It is possible to use, for example, those described in U.S. Pat. Nos. 3,227,554, 3,617,291, 3,701,783, 3,790,384 and 3,632,345, German Patent Application (OLS) Nos. 2,414,006, 2,454,301 and 2,454,329, British Pat. No. 953,454, Japanese Patent Application (OPI) Nos. 69624/77 and 122335/74 and Japanese Patent Publication No. 15141/76 as development inhibitor releasing (DIR) couplers.

The light-sensitive materials used in the present invention may contain compounds which release a development inhibitor on development, other than DIR couplers. For example, it is possible to use those described in U.S. Pat. Nos. 3,297,445 and 3,379,529, German Patent Application (OLS) No. 2,417,914 and Japanese Patent Application (OPI) Nos. 15271/77 and 9116/78.

Two or more of the above-described couplers may be present in the same layer, if desired. The same compound also may be present in two or more different layers, if desired. These couplers are generally employed in an amount of $2\times10^{-3}$ mol to $5\times10^{-1}$ mol, preferably $1\times10^{-2}$ mol to $5\times10^{-1}$ mol, per mol of silver in the emulsion layer.

Known processes can be used to introduce couplers into silver halide emulsion layers. For example, a process described in U.S. Pat. No. 2,322,027, etc., can be used. More specifically, after the couplers are dissolved in phthalic acid alkyl esters (for example, dibutyl phthalate and dioctyl phthalate, etc.), phosphoric acid esters (for example, diphenyl phosphate, triphenyl phosphate, tricresyl phosphate and dioctylbutyl phosphate), citric acid esters (for example, tributylacetylcitrate), benzoic acid esters (for example, octyl benzoate), alkylamides (for example, diethyllaurylamide), fatty acid esters (for example, dibutoxyethyl succinate) or trimesic acid esters, or organic solvents having a boiling point of about 30° to 150° C., for example, lower alkyl acetates such as ethyl acetate or butyl acetate, ethyl propionate, secondary butyl alcohol, methyl isobutyl ketone, β-ethoxyethyl acetate and methyl Cellosolve acetate, etc., they are dispersed in hydrophilic colloids. The above-described high boiling point organic solvents and the low boiling point organic solvents may be used alone or as a mixture thereof, if desired.

It is also possible to use the diffusion process that employs a polymer as described in Japanese Patent Publication No. 29853/76 and Japanese Patent Application (OPI) No. 59943/76.

In cases wherein the coupler has an acid group such as carboxylic acid and sulfonic acid, it may be introduced in the form of alkaline aqueous solution into the hydrophilic colloid.

Hydrophilic colloid layers used in the light-sensitive materials produced according to the present invention may contain ultraviolet ray absorbing agents. For example, it is possible to use benzotriazole compounds substituted with aryl groups (for example, those described in U.S. Pat. No. 3,533,794), 4-thiazolidone compounds (for example, those described in U.S. Pat. Nos. 3,314,794 and 3,352,681), benzophenone compounds (for example, those described in Japanese Patent Application (OPI) No. 2784/71), cinnamic acid ester compounds (for example, those described in U.S. Pat. Nos. 3,705,805 and 3,707,375), butadiene compounds (for example, U.S. Pat. No. 4,045,229) and benzoxazole compounds. Further, compounds described in U.S. Pat. No. 3,499,762 and Japanese Patent Application (OPI) No. 48535/79 can be employed. Ultraviolet ray absorbing couplers (for example, α-naphthol type cyan dye forming couplers) or ultraviolet ray absorbing polymers, etc., may be used, too. These ultraviolet ray absorbing agents may be mordanted in a specified layer, if desired.

The photographic emulsion layers in photographic light-sensitive materials of the present invention may contain polyalkylene oxides or derivatives thereof such as the ethers, esters or amines thereof, etc., thioether compounds, thiomorpholines, quaternary ammonium salt compounds, urethane derivatives, urea derivatives, imidazole derivatives and 3-pyrazolidones, etc., for the purpose of increasing sensitivity, improving contrast or accelerating development. For example, it is possible to use those compounds described in U.S. Pat. Nos. 2,400,532, 2,423,549, 2,716,062, 3,617,280, 3,772,021 and 3,808,003 and British Pat. No. 1,488,991, etc.

The photographic emulsions used in the present invention may be spectrally sensitized with methine dyes or other dyes. Examples of dyes which can be used include cyanine dyes, merocyanine dyes, complex cyanine dyes, complex merocyanine dyes, holopolar cyanine dyes, hemicyanine dyes, styryl dyes and hemioxonol dyes. Particularly useful dyes are cyanine dyes, merocyanine dyes and complex merocyanine dyes. In these dyes, it is possible to have any nucleus conventionally used for cyanine dyes as the basic heterocyclic nucleus. Namely, it is possible to have pyrroliine nucleus, oxazoline nucleus, thiazoline nucleus, pyrrole nucleus, oxazole nucleus, thiazole nucleus, selenazole nucleus, imidazole nucleus, tetrazole nucleus and pyridine nucleus, etc.; the above-described nuclei to which an alicyclic hydrocarbon ring is fused; and the above-described nuclei to which an aromatic hydrocarbon ring is fused, namely, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus, etc. These nuclei may have substituents on the carbon atoms thereof.

In merocyanine dyes and complex merocyanine dyes, 5- or 6-membered heterocyclic nuclei such as a pyrazolin-5-one nucleus, a thiohydantoin nucleus, a 2-thioxazolidine-2,4-dione nucleus, a thiazoline-2,4-dione nucleus, a rhodanine nucleus or a thiobarbituric acid nucleus, etc., may be present as nuclei having a ketomethylene structure.

The emulsions may contain dyes which do not have a spectral sensitization function themselves or substances which do not substantially absorb visible light but exhibit supersensitization together with the sensitizing dyes. For example, they may contain aminostyryl compounds (for example, those described in U.S. Pat. Nos. 2,933,390 and 3,635,721), aromatic organic acid-formaldehyde condensation products (for example, those described in U.S. Pat. No. 3,743,510), cadmium salts and azaindene compounds, etc. Combinations described in U.S. Pat. Nos. 3,615,613, 3,615,641, 3,617,295 and 3,635,721 are particularly useful.

In the light-sensitive materials produced according to the present invention, the hydrophilic colloid layers may contain water-soluble dyes as filter dyes or for the purpose of anti-irradiation and for other purposes. Examples of such dyes include oxonol dyes, hemioxonol dyes, styryl dyes, merocyanine dyes, cyanine dyes and azo dyes. Of these, oxonol dyes, hemioxonol dyes and merocyanine dyes are useful. Examples of dyes which can be used include those described in British Pat. Nos. 584,609 and 1,177,429, Japanese Patent Application (OPI) Nos. 85130/73, 99620/74, 11420/74 and 108115/77 and U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352.

In the light-sensitive materials produced according to the present invention, the photographic emulsion layers and other hydrophilic colloid layers may contain whitening agents such as stilbene type, triazine type, oxazole type or coumarine type whitening agents. They may be water-soluble, and water-insoluble whitening agents may be used in the form of a dispersion.

Examples of suitable fluorescent whitening agents are described in U.S. Pat. Nos. 2,632,701, 3,169,840 and 3,359,102 and British Pat. Nos. 852,075 and 1,319,763, etc.

In practicing the present invention, the following known anti-fading agents can be used also. Further, color image stabilizers which can be used in the present invention may be used alone or as a combination of two or more of them. Examples of known anti-fading agents include hydroquinone derivatives described in U.S. Pat. Nos. 2,360,290, 2,418,613, 2,675,314, 2,701,197, 2,704,713, 2,728,659, 2,732,300, 2,735,765, 2,710,801 and 2,816,028, and British Pat. No. 1,363,921, etc., gallic acid derivatives described in U.S. Pat. Nos. 3,457,079 and 3,069,262, etc., p-alkoxyphenols described in U.S. Pat. Nos. 2,735,765 and 3,698,909 and Japanese Patent Publication Nos. 20977/74 and 6623/77, p-oxyphenol derivatives described in U.S. Pat. Nos. 3,432,300, 3,573,050, 3,574,627 and 3,764,337 and Japanese Patent Application (OPI) Nos. 35633/77, 147434/77 and 152225/77, and bisphenols described in U.S. Pat. No. 3,700,455, etc.

The light-sensitive materials produced according to the present invention may contain hydroquinone derivatives, aminophenol derivatives, gallic acid derivatives and ascorbic acid derivatives, etc., as anti-color-fogging agents. Examples of such are described in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 92988/75, 92989/75, 93928/75, 110337/75 and 146235/77 and Japanese Patent Publication No. 23813/75.

The present invention can be employed as multi-layer multicolor photographic materials having at least two layers each with a different spectral sensitivity, on a support. Multilayer natural color photographic materials generally have at least a red-sensitive silver halide emulsion layer, at least a green-sensitive silver halide emulsion layer and at least a blue-sensitive silver halide emulsion layer on a support. The order of these layers is suitably selected as needed. In general, the red-sensitive emulsion layer contains a cyan coupler, the green-sensitive emulsion layer contains a magenta coupler, and the blue-sensitive emulsion layer contains a yellow coupler, but, if desired, other combinations can be utilized.

In order to carry out photographic processing of the light-sensitive materials of the present invention, any known process can be used and known processing solutions can be used, also. Further, the processing temperature can be selected from a range of 18° C. to 50° C. in general, but a temperature lower than 18° C. or a temperature higher than 50° C. can be used, if desired. In particular, the light-sensitive material of the present invention is suitable for high temperature treatment at 30° C. or higher.

The color developing solution employed is generally composed of an alkaline aqueous solution containing a color developing agent. Suitable color developing agents which can be used include known primary aromatic amine developing agents, for example, phenylenediamines (for example, 4-amino-N,N-diethylaniline, 3-methyl-4-amino-N,N-diethylaniline, 4-amino-N-ethyl-N-β-hydroxyethylaniline, 3-methyl-4-amino-4-ethyl-N-β-hydroxyethylaniline, 3-methyl-4-amino-N-ethyl-N-β-methanesulfonamidoethylaniline and 4-amino-3-methyl-N-ethyl-N-β-methoxyethylaniline, etc.).

In addition, the compounds described in L.F.A. Mason, *Photographic Processing Chemistry,* pages 226–229 (published by Focal Press, 1966), U.S. Pat. Nos. 2,193,015 and 2,592,364 and Japanese Patent Application (OPI) No. 64933/73, etc., may be used.

The color developing solution may contain pH buffer agents such as alkali metal sulfites, carbonates, borates or phosphates, and development restrainers or antifogging agents such as bromides, iodides or organic antifoggants, etc. Further, the developing solution may contain, as the occasion demands, water softeners, preservatives such as hydroxylamine, organic solvents such as benzyl alcohol or diethylene glycol, development accelerators such as polyethylene glycol, quaternary ammonium salts or amines, dye forming couplers, competing couplers, fogging agents such as sodium borohydride, auxiliary developing agents such as 1-phenyl-3-pyrazolidone, viscosity increasing agents, polycarboxylic acid type chelating agents described in U.S. Pat. No. 4,083,723, and antioxidants described in German Patent Application (OLS) No. 2,622,950, etc.

The photographic emulsion layers after color development are generally subjected to bleaching processing. The bleaching processing may be carried out simultaneously with the fixing processing or may be carried out separately. Suitable bleaching agents include compounds of polyvalent metals such as iron (III), cobalt (III), chromium (VI) or copper (II), etc., peracids, quinones and nitroso compounds, etc. For example, it is possible to use ferricyanides, bichromates, organic complex salts of iron (III) or cobalt (III), for example, complex salts of aminopolycarboxylic acids such as ethylenediaminetetraacetic acid, nitrilotriacetic acid or 1,3-diamino-2-propanoltetraacetic acid, etc., or organic acids such as citric acid, tartaric acid or malic acid, etc.; persulfates, permanganates; and nitrosophenol, etc. Of these, potassium ferricyanide, sodium ethylenediaminetetraacetato iron (III) complex and ammonium ethylenediaminetetraacetato iron (III) complex are particularly useful. Ethylenediaminetetraacetato iron (III) complex salts are available in both bleaching solution and one-bath bleach-fixing solution and it is possible to add various additives such as bleaching accelerators described in U.S. Pat. Nos. 3,042,520 and 3,241,966 and Japanese Patent Publication Nos. 8506/70 and 8836/70, etc., thiol compounds described in Japanese Patent Application (OPI) No. 65732/78, and other compounds.

The invention is now described with reference to the following examples, which are not intended to limit the scope of this invention.

The couplers used for comparison in Examples 1 to 4 are shown below.

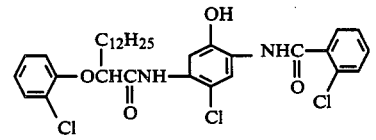
CR-1

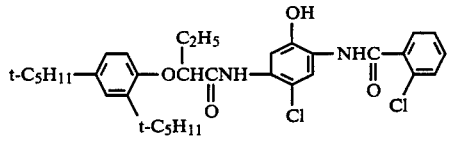
CR-2

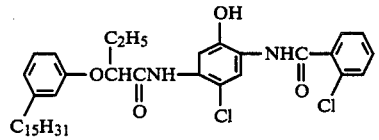
CR-3

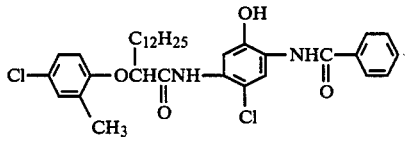
CR-4

-continued

CR-5

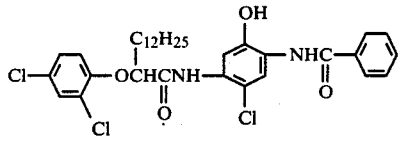

CR-6

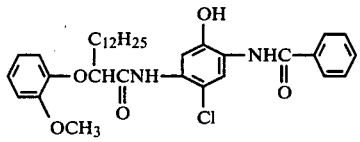

CR-7

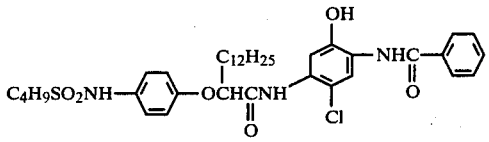

CR-8

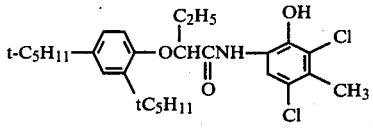

MR-1

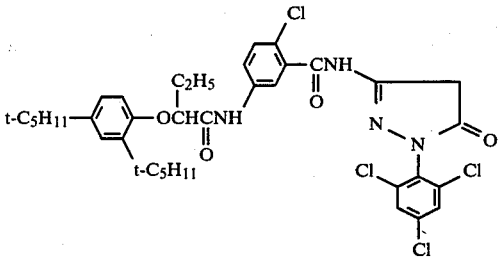

MR-2

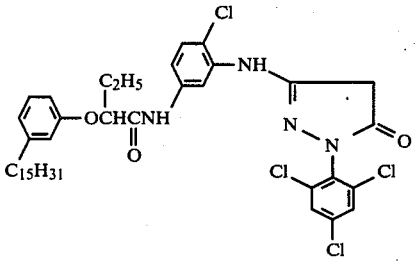

YR-1

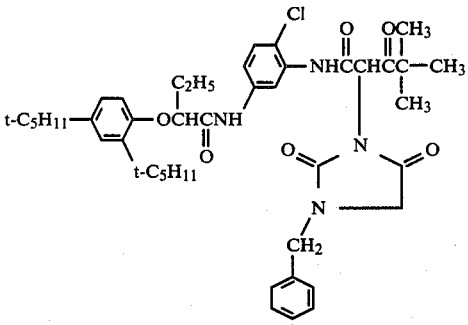

-continued

YR-2

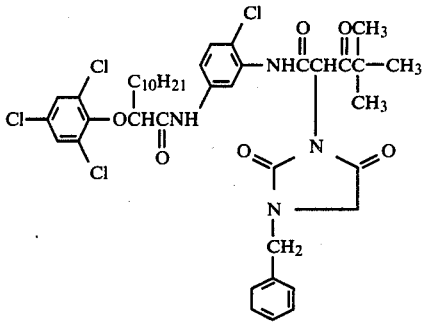

EXAMPLE 1

A coupler emulsion was prepared by dissolving with heating 10 g of Coupler (1) of the invention in a mixed solvent of dibutyl phthalate (5 ml) and ethyl acetate (10 ml), mixing the resulting solution with 100 ml of 10% gelatin aqueous solution containing 0.1 g of sodium dodecylbenzenesulfonate, and emulsifying the mixture in a homogenizer at 50° C. The emulsion was mixed with 150 g of silver chlorobromide emulsion. To the emulsion mixture were added 15 ml of 2% aqueous solution of 2-hydroxy-4,6-dichloro-s-triazine sodium salt and 6 ml of 5% aqueous solution of saponin. The thus obtained emulsion was applied to a cellulose triacetate support so that the silver quantity was 1 g/m$^2$. Finally, the emulsion layer was covered with a 1 $\mu$m thick gelatin protective layer. This light-sensitive material was designated as Sample A.

Samples B to X were prepared in an analogous manner to that of Sample A from various couplers as shown in Table 1. (The mol weight of the coupler used and the quantity of silver applied were the same as in Sample A.)

Samples A to X were exposed in regular steps for sensitometry and processed for development as follows:

| Process | Temperature (°C.) | Time (min) |
|---|---|---|
| Color Development | 38 | 3 |
| Washing with Water | 38 | 1 |
| Bleach-Fix | 38 | 1.5 |
| Washing with Water | 38 | 1 |

The composition of the color developing solution was as follows:

| | CD-1 | CD-2 | CD-3 |
|---|---|---|---|
| Benzyl alcohol | — | — | 15 ml |
| Diethylene glycol | — | — | 8 ml |
| Developing agent | 4-Amino-3-methyl-N—ethyl-N—β-hydroxy- | 4-Amino-3-methyl-N—ethyl-N—β-(methane- | 4-Amino-3-methyl-N—ethyl-N—β-(methane- |

-continued

| | CD-1 | CD-2 | CD-3 |
|---|---|---|---|
| | ethylaniline sulfate | sulfonamido)ethyl-aniline sulfate | sulfonamido)ethyl-aniline sulfate |
| | 3.5 g | 5 g | 5 g |
| Sodium sulfite | 2 g | 2 g | 2 g |
| Hydroxylamine hydrosulfate | 3 g | 3 g | 3 g |
| Potassium carbonate | 30 g | 30 g | 30 g |
| Water to make | 1 l | 1 l | 1 l |
| pH (adjusted) | 10.2 | 10.2 | 10.2 |

The composition of the bleach-fix solution was as follows:

| | |
|---|---|
| Disodium Ethylenediaminetetraacetate | 2 g |
| Diferric Ethylenediaminetetraacetate | 40 g |
| Sodium Sulfite | 5 g |
| Sodium Thiosulfate | 70 g |
| Water to make | 1 liter |
| Adjusted to pH 6.8 | |

The maximum transmission density of each sample was measured (with respect to the density of yellow dye, magenta dye, and cyan dye). The maximum density Dmax and the gamma ($\gamma$) were obtained. The results are shown in Table 1.

TABLE 1

| | | CD-1 | | CD-2 | | CD-3 | |
|---|---|---|---|---|---|---|---|
| Sample | Coupler | Dmax | $\gamma$ | Dmax | $\gamma$ | Dmax | $\gamma$ |
| A | (1) | 3.38 | 2.92 | 3.29 | 2.78 | 3.39 | 2.89 |
| B | (2) | 3.26 | 2.82 | 3.26 | 2.82 | 3.31 | 2.91 |
| C | (3) | 3.28 | 2.91 | 3.24 | 2.90 | 3.34 | 2.98 |
| D | (4) | 3.31 | 2.92 | 3.20 | 2.87 | 3.36 | 2.99 |
| E | (5) | 3.18 | 2.81 | 3.16 | 2.78 | 3.19 | 2.78 |
| F | (7) | 3.24 | 2.90 | 3.22 | 2.68 | 3.24 | 2.80 |
| G | (8) | 3.30 | 2.93 | 3.18 | 2.81 | 3.24 | 2.80 |
| H | (10) | 3.15 | 2.82 | 3.21 | 2.92 | 3.38 | 2.92 |
| I | (13) | 3.21 | 2.91 | 3.35 | 2.98 | 3.38 | 2.96 |
| J | (19) | 3.28 | 2.92 | 3.18 | 2.69 | 3.38 | 2.98 |
| K | CR-1 | 2.68 | 2.41 | 2.61 | 2.13 | 3.00 | 2.79 |
| L | CR-2 | 2.71 | 2.52 | 2.48 | 2.44 | 2.87 | 2.58 |
| M | CR-3 | 2.69 | 2.55 | 2.67 | 2.42 | 2.69 | 2.56 |
| N | CR-5 | 2.72 | 2.48 | 2.40 | 2.13 | 2.91 | 2.61 |
| O | (24) | 3.28 | 2.89 | 3.38 | 2.98 | 3.50 | 3.00 |
| P | (25) | 3.40 | 2.89 | 3.45 | 2.99 | 3.48 | 2.98 |
| Q | (26) | 3.21 | 2.87 | 3.21 | 2.88 | 3.24 | 3.01 |
| R | MR-1 | 2.81 | 2.51 | 2.50 | 2.41 | 2.88 | 2.71 |
| S | MR-2 | 2.60 | 2.31 | 2.70 | 2.21 | 2.81 | 2.61 |
| T | (21) | 3.29 | 2.98 | 3.28 | 2.82 | 3.29 | 2.98 |
| U | (22) | 3.21 | 2.88 | 3.25 | 2.79 | 3.31 | 2.99 |
| V | (23) | 3.22 | 2.90 | 3.24 | 2.87 | 3.40 | 3.01 |
| W | YR-1 | 2.05 | 2.09 | 2.15 | 2.09 | 2.50 | 2.40 |
| X | YR-2 | 2.51 | 2.20 | 2.54 | 2.18 | 2.69 | 2.58 |

It is noted from Table 1 that the Samples A to J, O to Q, and T to V which contain the coupler of this invention all exhibited good color development, whereas Comparative Samples K to N, R, S, W, and X were poor in color development, with the density at Dmax and $\gamma$ being low.

The comparative samples were particularly poor in color development when developed with CD-2 which contains no benzyl alcohol, as compared with when developed with CD-3, although both CD-2 and CD-3 contain the same relatively active developing agent. In the case of the samples of this invention, however, CD-2 and CD-3 gave only a slight difference in color development. In other words, the samples of the present invention can be developed satisfactorily by a developer containing no benzyl alcohol.

EXAMPLE 2

Color photographic light-sensitive materials (Samples 2A to 2C) were prepared by forming six layers on polyethylene-laminated (both sides) paper as shown in Table 2.

The emulsion for the first layer (bottom layer) was prepared as follows. 100 g of yellow coupler was dissolved in a mixed solvent composed of 166.7 ml of dibutyl phthalate (DBP) and 200 ml of ethyl acetate. The resulting solution was emulsified in 800 g of 10% gelatin aqueous solution containing 80 ml of 1% solution of sodium dodecylbenzenesulfonate. The emulsion was mixed with 1,450 g of emulsion of blue-sensitive silver chlorobromide (Br: 80 mol%), containing 66.7 g of silver.

The smulsions for other layers were also prepared in the similar way. Each layer was incorporated with 2,4-dichloro-6-hydroxy-s-triazine sodium salt as a hardener.

The following spectral sensitizers were used.

For blue-sensitive emulsion layer:

3,3'-di($\gamma$-sulfopropyl)selenacyanine sodium salt ($2\times10^{-4}$ mol per mol of silver halide)

For green-sensitive emulsion layer:

3,3'-di($\gamma$-sulfopropyl)-5,5'-diphenyl-9-ethyloxacarbocyanine sodium salt ($2.5\times10^{-4}$ mol per mol of silver halide)

For red-sensitive emulsion layer:

3,3'-di($\gamma$-sulfopropyl)-9-methyl-thiadicarbocyanine sodium salt ($2.5\times10^{-4}$ mol per mol of silver halide)

Each emulsion layer was incorporated with the following dye for the prevention of irradiation.

For the green-sensitive emulsion layer:

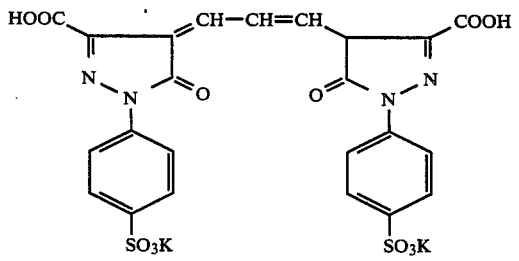

For the red-sensitive emulsion layer:

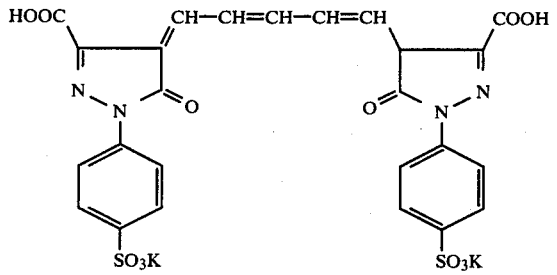

The solvents, DBP and TOP, shown in Table 2 have the following structural formulae.

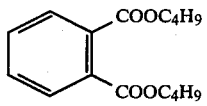

DBP

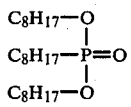

TOP

TABLE 2

| | | Sample | | |
|---|---|---|---|---|
| | | 2A | 2B | 2C |
| The 6th Layer (protective layer) | Gelatin quantity (mg/m²) | 1,500 | 1,500 | 1,500 |
| The 5th Layer (red-sensitive layer) | Silver chlorobromide emulsion (Br: 50%) Ag quantity (mg/m²) | 300 | 300 | 300 |
| | Cyan coupler | CR-1 | (1) | (2) |
| | quantity (mg/m²) | 400 | 570 | 640 |
| | Solvent | DBP | DBP | DBP |
| quantity (mg/m²) | 240 | 340 | 380 | |
| The 4th Layer (UV-absorbing layer) | Gelatin quantity (mg/m²) | 2,000 | 2,000 | 2,000 |
| | UV absorber | UV-1, 15 | UV-1, 15 | UV-1, 15 |
| | quantity (mg/m²) | UV-2, 45 | UV-2, 45 | UV-2, 45 |
| | | UV-3, 90 | UV-3, 90 | UV-3, 90 |
| | Solvent | DBP | DBP | DBP |
| | quantity (mg/m²) | 60 | 60 | 60 |
| The 3rd Layer (green-sensitive layer) | Silver chlorobromide emulsion (Br: 70%) Ag quantity (mg/m²) | 450 | 450 | 450 |
| | Magenta coupler | MR-1 | (24) | (25) |
| | quantity (mg/m²) | 350 | 490 | 470 |
| | Solvent | TOP | TOP | TOP |
| | quantity (mg/m²) | 440 | 620 | 590 |
| The 2nd Layer (interlayer) | Gelatin quantity (mg/m²) | 1,500 | 1,500 | 1,500 |
| The 1st Layer (blue-sensitive layer) | Silver chlorobromide emulsion (Br: 80%) Ag quantity (mg/m²) | 400 | 400 | 400 |
| | Yellow coupler | YR-1 | (21) | (22) |
| | quantity (mg/m²) | 600 | 730 | 590 |
| | Solvent | DBP | DBP | DBP |
| | quantity (mg/m²) | 1,000 | 1,220 | 980 |
| Support | Polyethylene laminated (both sides) paper support | | | |

The samples were exposed in regular steps for sensitometry and processed for development in the same way as in Example 1, except that only CD-2 and CD-3 were used as the color developers.

The reflection density (red, green, and blue) of each processed sample was measured. The fog, maximum density Dmax, and gamma (γ) were obtained. The results are shown in Table 3.

TABLE 3

| Sample | Cyan Fog | Cyan Dmax | Cyan γ | Magenta Fog | Magenta Dmax | Magenta γ | Yellow Fog | Yellow Dmax | Yellow γ |
|---|---|---|---|---|---|---|---|---|---|
| | | | | | CD-2 | | | | |
| 2A | 0.10 | 2.13 | 2.60 | 0.07 | 2.22 | 2.50 | 0.09 | 2.08 | 2.30 |
| 2B | 0.10 | 2.80 | 3.30 | 0.07 | 34.09 | 3.41 | 0.07 | 2.91 | 3.31 |
| 2C | 0.10 | 2.91 | 3.28 | 0.07 | 2.93 | 3.43 | 0.08 | 2.90 | 3.30 |
| | | | | | CD-3 | | | | |
| 2A | 0.11 | 2.68 | 2.90 | 0.08 | 2.68 | 2.82 | 0.10 | 2.40 | 2.56 |
| 2B | 0.12 | 2.83 | 3.30 | 0.08 | 3.08 | 3.41 | 0.09 | 2.98 | 3.35 |
| 2C | 0.11 | 2.93 | 3.35 | 0.08 | 2.98 | 3.45 | 0.09 | 2.95 | 3.35 |

It is noted from Table 3 that the Comparative Sample 2A exhibited a considerable decrease in gamma (γ) and Dmax when it was processed with CD-2 which contains no benzyl alcohol, whereas Samples 2B and 2C of the present invention exhibited satisfactory color development when processed with CD-2.

UV-absorbers UV-1, UV-2 and UV-3 are compounds represented by the following structural formulae.

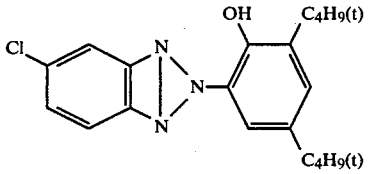

UV-1

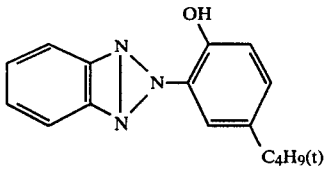

UV-2

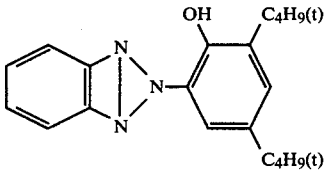

UV-3

EXAMPLE 3

Color photographic light-sensitive material (Sample 3A) was prepared by forming six layers on polyethylene laminated (both sides) paper as shown in Table 4, in which the quantity applied is expressed in terms of mg/m$^2$.

TABLE 4

| | | |
|---|---|---|
| The 6th Layer (protective layer) | Gelatin | 1,600 mg/m$^2$ |
| The 5th Layer (red-sensitive layer) | Silver chlorobromide emulsion (AgBr: 50 mol%) Ag quantity | 300 mg/m$^2$ |
| | Sensitizing dye*1 | 0.05 mg/m$^2$ |
| | Cyan coupler*2 | 400 mg/m$^2$ |
| | Solvent for coupler*3 | 300 mg/m$^2$ |
| | Gelatin | 500 mg/m$^2$ |
| The 4th Layer (UV-absorbing layer) | UV absorber*4 | 600 mg/m$^2$ |
| | Solvent for UV absorber*3 | 300 mg/m$^2$ |
| | Gelatin | 800 mg/m$^2$ |
| The 3rd Layer (green-sensitive | Silver chlorobromide emulsion (AgBr: 70%) Ag quantity | 500 mg/m$^2$ |
| | Magenta coupler*5 | 400 mg/m$^2$ |
| | Anti-discoloration agent*6 | 200 mg/m$^2$ |
| | Solvent for coupler*7 | 400 mg/m$^2$ |
| | Gelatin | 700 mg/m$^2$ |
| The 2nd Layer (interlayer) | Gelatin | 1,000 mg/m$^2$ |
| The 1st Layer (blue-sensitive layer) | Silver chlorobromide emulsion (AgBr: 80 mol%) Ag quantity | 400 mg/m$^2$ |
| | Yellow coupler*8 | 500 mg/m$^2$ |
| | Solvent for coupler*3 | 400 mg/m$^2$ |
| | Gelatin | 700 mg/m$^2$ |
| Support | Polyethylene laminated (both sides) paper support | |

TABLE 4-continued

*1Sensitizing Dye: Potassium 2-[5-[4-(6-methyl-3-pentylbenzothiazoline-2-ylidene)-2-methyl-2-butenylidene]-3-rhodanine]-acetate
*2Coupler: 2-[ α-(2,4-Di-tert-pentylphenoxy)-butanamide]-4,6-dichloro-5-methylphenol
*3Solvent: Trinonyl phosphate
*4UV Absorber: 2-(2-Hydroxy-3-sec-butyl-5-tert-butylphenol)benzotriazole
*5coupler: 1-(2,4,6-Trichlorophenyl)-3-(2-chloro-5-tetradecanamide)anilino-2-pyrazolone-5-one
*6Anti-Discoloration Agent: 2,5-Di-tert-hexylhydroquinone
*7Solvent: Tricresyl phosphate
*8Coupler: α-Pivaloyl-α-(2,4-dioxy-5,5'-dimethyl-oxazolizine-3-yl)-2-chloro-5-[α-(2,4-di-tert-pentyloxy)butanamide]-acetanilide Samples 3B to 3L were prepared in an analogous manner as Sample 3A, except that the cyan coupler was replaced by the couplers shown in Table 5.

TABLE 5

| Sample | Cyan Coupler | |
|---|---|---|
| 3B | Compound (1) of the invention | 490 mg/m$^2$ |
| 3C | Compound (2) of the invention | 500 mg/m$^2$ |
| 3D | Compound (3) of the invention | 530 mg/m$^2$ |
| 3E | Compound (4) of the invention | 550 mg/m$^2$ |
| 3F | Compound (5) of the invention | 570 mg/m$^2$ |
| 3G | Compound (6) of the invention | 510 mg/m$^2$ |
| 3H | Compound (1) of the invention | 250 mg/m$^2$ |
| | Coupler of Sample A | 200 mg/m$^2$ |
| 3I | Coupler for comparison, CR-1 | 510 mg/m$^2$ |
| 3J | Coupler for comparison, CR-2 | 490 mg/m$^2$ |
| 3K | Coupler for comparison, CR-3 | 540 mg/m$^2$ |
| 3L | Coupler for comparison, CR-4 | 470 mg/m$^2$ |

The samples were exposed to red light through a continuous wedge and developed as follows:

| Process | | |
|---|---|---|
| Color Development (3A) or (3B) | 33° C. | 3.5 min |
| Bleach-Fix | 33° C. | 1.5 min |
| Washing with Water | 30° C. | 3 min |
| Drying | | |

| Composition of Color Developing Solution (3A) | |
|---|---|
| Benzyl Alcohol | 15 ml |
| Sodium Sulfite | 5 g |
| Potassium Bromide | 0.4 g |
| Hydroxylamine Sulfate | 2 g |
| 4-Amino-3-methyl-N—ethyl-N—β-(methanesulfonamide) | 2 g |
| Sodium Carbonate (monohydrate) | 30 g |
| Water to make | 1,000 ml |
| pH 10.1 | |

Composition of Color Developing Solution (3B)

Same as (3A) except that benzyl alcohol is removed.

| Composition of Bleach-Fix Solution | |
|---|---|
| Ferric Ethylenediaminetetraacetate | 45 g |
| Sodium Sulfite | 10 g |
| 70% Aqueous Solution of Ammonium Thiosulfate | 160 ml |
| Tetrasodium Ethylenediaminetetra-acetate | 5 g |
| Water to make | 1,000 ml |
| pH 6.8 | |

The color density of each processed sample was measured. The fog, gamma, and maximum density Dmax are shown in Table 6.

TABLE 6

| Sample | Color Developing Solution (3A) Fog | γ | Dmax | Color Developing Solution (3B) Fog | γ | Dmax | Note |
|---|---|---|---|---|---|---|---|
| 3A | 0.11 | 2.84 | 2.95 | 0.10 | 2.20 | 2.55 | *1 |
| 3B | 0.12 | 2.88 | 3.26 | 0.12 | 2.80 | 3.25 | *2 |
| 3C | 0.11 | 2.86 | 3.22 | 0.11 | 2.77 | 3.14 | *2 |
| 3D | 0.10 | 2.91 | 3.30 | 0.10 | 2.83 | 3.23 | *2 |
| 3E | 0.11 | 2.85 | 3.25 | 0.10 | 2.80 | 3.20 | *2 |
| 3F | 0.11 | 2.87 | 3.19 | 0.10 | 2.75 | 3.15 | *2 |
| 3G | 0.11 | 2.83 | 3.11 | 0.11 | 2.75 | 3.07 | *2 |
| 3H | 0.12 | 2.89 | 3.24 | 0.11 | 2.72 | 3.06 | *2 |
| 3I | 0.12 | 2.81 | 3.01 | 0.11 | 2.31 | 2.65 | *1 |
| 3J | 0.11 | 2.90 | 3.07 | 0.10 | 2.35 | 2.61 | *1 |
| 3K | 0.11 | 2.82 | 3.02 | 0.11 | 2.26 | 2.59 | *1 |
| 3L | 0.11 | 2.83 | 3.07 | 0.11 | 2.30 | 2.67 | *1 |

*1Comparative Example
*2Example of the Present Invention

It is noted from Table 6 that the Comparative Samples 3A and 3I to 3L were very poor in color development when processed with the color developing solution which contains no benzyl alcohol, whereas the Samples 3B to 3H of the present invention exhibited satisfactory color development with almost no decrease in the maximum density and gamma.

EXAMPLE 4

In this example, it is demonstrated that the coupler of the present invention is more soluble in a high-boiling solvent than known couplers of the similar structure. The results are shown in Table 7.

TABLE 7

| Kind of Coupler | Quantity of DBP (ml) | Quantity of TOP (ml) |
|---|---|---|
| Coupler (1) of the invention | 1.0 | 1.0 |
| Coupler (2) of the invention | 0.8 | 1.0 |
| Coupler (3) of the invention | 0.8 | 0.8 |
| Coupler (4) of the invention | 0.6 | 1.0 |
| Coupler (6) of the invention | 0.6 | 1.0 |
| Coupler (4) of the invention | 0.4 | 0.4 |
| CR-1 | 3.0 | 3.2 |
| CR-2 | 5.0 | 4.0 |
| CR-3 | 2.5 | 5.2 |
| Coupler (5) of the invention | 0.8 | 1.0 |
| Coupler (8) of the invention | 1.0 | 0.8 |
| CR-4 | 4.5 | 3.0 |
| CR-5 | 4.0 | 4.0 |
| Cr-6 | 6.0 | 5.0 |
| CR-7 | 5.0 | 3.0 |
| Coupler (19) of the invention | 2.0 | 1.8 |
| CR-8 | 3.0 | 3.0 |
| Coupler (24) of the invention | 2.0 | 2.5 |
| MR-1 | 6.8 | 6.0 |
| Coupler (21) of the invention | 1.0 | 2.0 |
| YR-1 | 3.0 | 4.0 |

Table 7 shows the quantity of solvent necessary to dissolve $1.5\times10^{-3}$ mol of coupler at 50° C. It is understood from Table 7 that the couplers of the present invention are more soluble in high-boiling solvents than the known comparative couplers, and this property is advantageous in the production of silver halide photographic light-sensitive materials.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a coupler represented by formula (II):

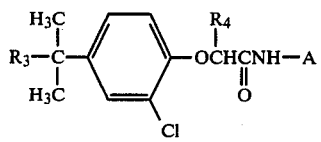

(II)

wherein A represents the residue of a coupler, $R_3$ represents an alkyl group having from 1 to 7 carbon atoms, $R_4$ represents an alkyl group having from 4 to 16 carbon atoms, with the total number of carbon atoms of $R_3$ and $R_4$ being from 8 to 22.

2. A silver halide color photographic light-sensitive material as in claim 1, wherein the compound represented by formula (II) is represented by formula (III):

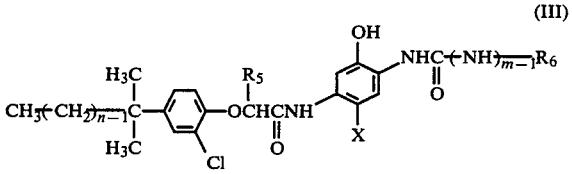

(III)

wherein $R_5$ represents an alkyl group having from 4 to 12 carbon atoms, $R_6$ represents an aryl group having from 6 to 12 carbon atoms, an alkyl group having from 1 to 20 carbon atoms, or a 5- or 6-membered heterocyclic group, n is an integer of 1 to 6, m is an integer of 1 or 2, and X represents a group which can be eliminated by an oxidation coupling reaction with a color developing agent.

3. A silver halide color photographic light-sensitive material as in claim 2, wherein the coupler represented by formula (III) is represented by formula (IV):

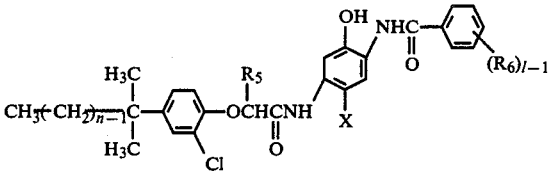

(IV)

wherein $R_6$ represents a halogen atom, an alkyl group having from 1 to 4 carbon atoms, or an alkoxy group having from 1 to 4 carbon atoms, l is an integer of 1 to 6, and when l is an integer of 3 or more, the groups represented by $R_6$ may be the same or different, $R_5$ represents an alkyl group having from 4 to 12 carbon atoms, n is an integer of 1 to 6, and X represents a group which can be eliminated by an oxidation coupling reaction with a color developing agent.

4. A silver halide color photographic light-sensitive material as in claim 1, wherein A in the formula (II) represents the residue of a yellow coupler, a magenta coupler, a cyan coupler or a coupler which forms black or gray or substantially no dye.

5. A silver halide color photographic light-sensitive material as in claim 1, wherein A in the formula (II) represents a yellow coupler residue selected from the group consisting of residues of couplers of a pivaloyl acetanilide type, benzoyl acetanilide type, malonic diester type, malonic diamide type, dibenzoyl methane type, benzothiazolyl acetamide type, malonic ester monoamide type, benzothizolyl acetate type, benzoxazolyl acetamide type, benzoxazolyl acetate type, benzimidazolyl acetamide type and benzimidazolyl acetate type.

6. A silver halide color photographic light-sensitive material as in claim 1, wherein A in the formula (II) represents the residue which is selected from the group consisting of residues of couplers of a 5-oxo-2-pyrazoline type, pyrazolobenzimidazole type, pyrazolotirazole type, cyanoacetophenone type, pyrazoloimidazole type and N-heterocyclic ring substituted acylacetamide type.

7. A silver halide color photographic light-sensitive material as in claim 1, wherein A in the formula (II) represents the residue which is elected from the group consisting of a residue having a phenol nucleus and a residue having an $\alpha$-naphthol nucleus.

8. A silver halide color photographic light-sensitive material as in claim 1, wherein A in the formula (II) represents the residue of a coupler which forms a black or a gray dye and which is selected from a group consisting of resorcin and 3-aminophenol.

9. A silver halide color photographic light-sensitive material as in claim 1, wherein A in the formula (II) represents the residue of a coupler which forms substantially no dye and which is selected from a group consisting of an indanone type coupler and an acetophenone type coupler.

* * * * *